United States Patent [19]

Ciccotelli

[11] Patent Number: 5,017,169

[45] Date of Patent: May 21, 1991

[54] SWIM FIN

[76] Inventor: Stephen S. Ciccotelli, P.O. Box 1414, Deming, N. Mex. 88031

[21] Appl. No.: 434,252

[22] Filed: Nov. 13, 1989

[51] Int. Cl.[5] ..... A63B 31/11

[52] U.S. Cl. ..... 441/61; 441/64

[58] Field of Search ..... 441/61–64

[56] References Cited

U.S. PATENT DOCUMENTS

| | | | |
|---|---|---|---|
| 1,061,264 | 5/1913 | Bys | 441/64 |
| 3,072,932 | 1/1963 | Ciccotelli | 441/64 |
| 3,665,535 | 5/1972 | Picken | 441/64 |

FOREIGN PATENT DOCUMENTS

| | | | |
|---|---|---|---|
| 1208636 | 2/1960 | France | 441/64 |

*Primary Examiner*—Sherman Basinger

*Attorney, Agent, or Firm*—William J. Ruano

[57] ABSTRACT

A swim fin having a low drag profile foot pocket-beam assembly, achieved by attaching a single beam to the bottom of the foot pocket to support the rigid blade. Such construction has the added advantages of making it possible to taper the sides of the toe portion of the foot pocket to generally conform to the shape of the foot, reducing the drag profile of the foot pocket and positioning the single beam so-that it is behind the foot pocket during swimming, thereby improving swim fin efficiency.

3 Claims, 2 Drawing Sheets

SWIM FIN

This invention relates to improvements in a swim fin comprising an improvement over U.S. Pat. No. 4,869,696.

BACKGROUND OF THE INVENTION

This invention relates to the type of swim fin in which a rigid blade is spaced from the foot pocket and the center portion of the leading edge of the rigid blade is pivotally attached to support means which projects forwardly from the foot pocket.

The foot pocket of the swim fin of U.S. Pat. No. 4,869,696 is designed to fit over either booted foot and is shaped so that the support beams can be attached to the sides of the foot pocket. This results in the toe portion being square shaped and bulky and consequently generating much drag and turbulance during swimming.

Another problem with the swim fin of U.S. Pat. No. 4,869,696 is that the two beams, the strut and the two links are located at different positions relative to the rigid blade. These components not only generate drag and turbulance but because of their proximity to the blade and because they are spread out reduce blade efficiency in another way namely, by reducing the amount of blade area that acts on undisturbed water during swimming.

SUMMARY OF THE INVENTION

It is an object of this invention to provide a swim fin that is economical to manufacture and has a low drag profile foot pocket-beam assembly. This is achieved by attaching a single beam to the bottom of the foot pocket to support the rigid blade. This construction has the added advantages of making it possible to taper the sides of the toe portion of the foot pocket to generally conform to the shape of the foot thereby reducing the drag profile of the foot pocket and to position the single beam so that it is behind the foot pocket during swimming thereby improving swim fin efficiency.

It is another object of this invention to provide hinge means to pivotally attach the rigid blade to the single beam that can withstand the torsional forces generated by the rigid blade during swimming.

It is another object of this invention to provide means for attaching the single beam to the foot pocket so that the rigid blade-single beam assembly is supported in a torsional direction during swimming.

It is another object of this invention to position the beam, the portion of the strut that projects from the rigid blade and the non-elastic components that limit the arcuate movement of the end of the strut in one location relative to the rigid blade so that more blade surface acts on undisturbed water during swiming.

It is a further object of this invention to provide alternate low drag, low cost, non-elastic means to limit the extent of the angular movement of the rigid blade.

Further objects and advantages of my invention will appear as the specification proceeds.

DESCRIPTION OF THE PREFERRED EMBODIMENTS

Figure 1:
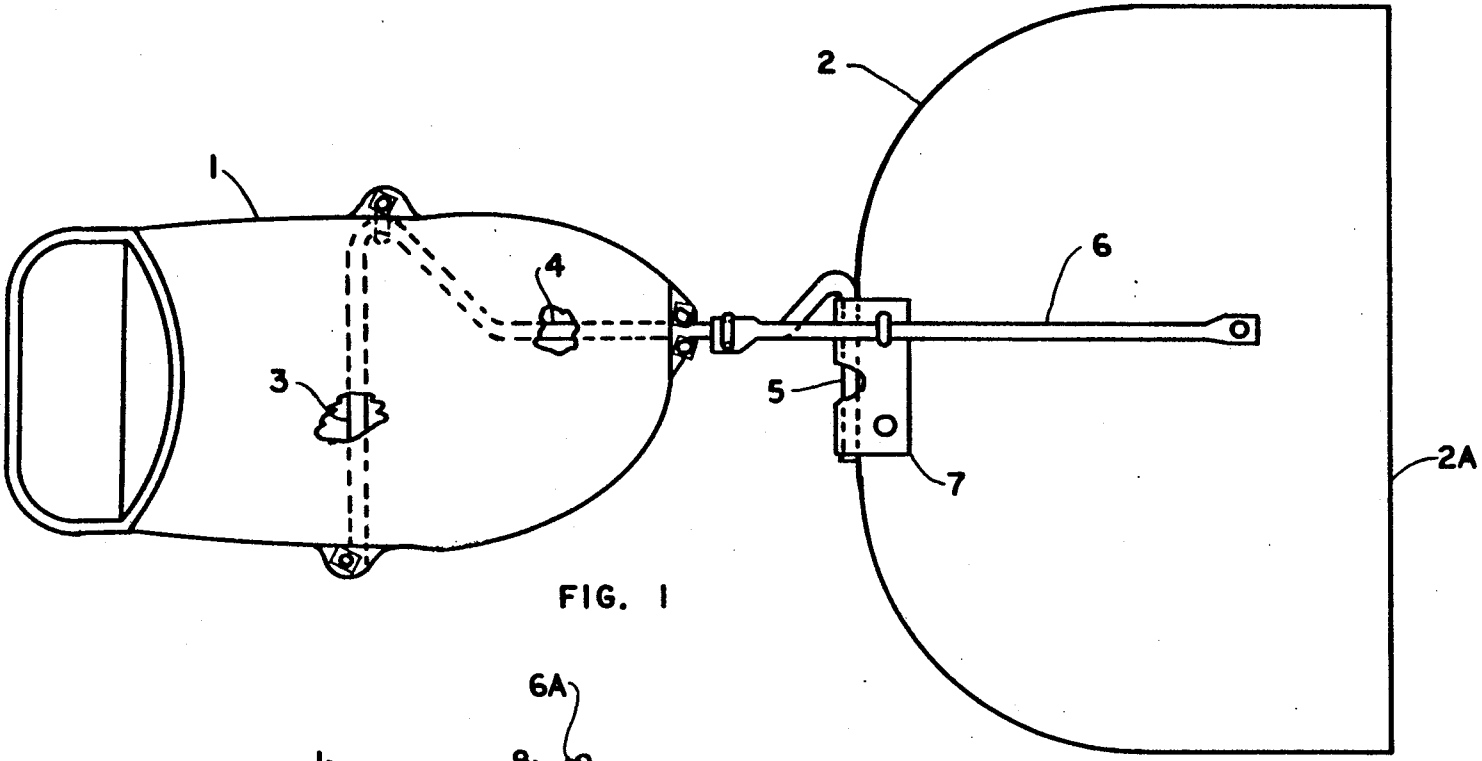
FIG. 1 is a top view of the swim fin.

Referring to FIG. 1 of the drawings, the foot pocket 1 has a single beam 4 which is attached to the bottom of the foot pocket and which projects forwardly therefrom. A cross-member 5 is fixedly attached to the end of the single beam 4. A rigid member 3 supports the rigid blade in a torsional direction during swimming.

The single beam 4, the cross-member 5 and the rigid member 3 may be constructed separately (not shown) or constructed as a one piece wire form as shown.

The rigid blade 2 is pivotally attached to the cross-member 5 by means of a hinge element 7 which is fixedly attached to the leading edge of the rigid blade 2 at a position that is located in front of the toe of the foot pocket 1, the cross-member 5 serving as a hinge pin and also as a structural member to support the rigid blade in a torsional direction.

A strut 6 is fixedly attached to the rigid blade 2 and projects toward the toe of the foot pocket 1. A portion of the strut 6 that projects from the rigid blade 2 is shown contacting the single beam 4 and farther angular movement in that direction is stopped.

Figure 2:
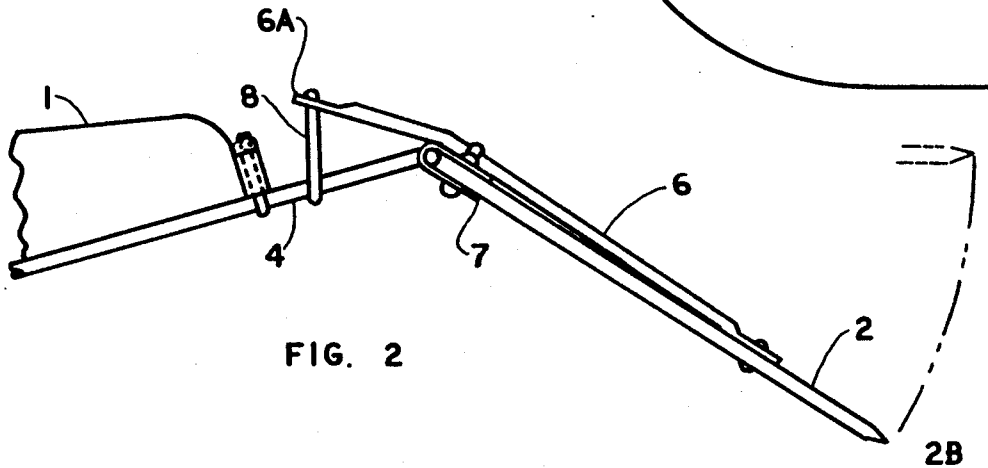
FIG. 2 is a partial side view of the swim fin.

Referring to the partial side view of the swim fin, FIG. 2 the trailing edge 2A of the rigid blade 2 has pivoted to point 2B. The end of the strut 6A, has pivoted away from the single beam 4 and farther angular movement of the rigid blade 2 is stopped by a loop shaped link 8 connected to the end of the strut 6 and the single beam 4.

Figure 3:
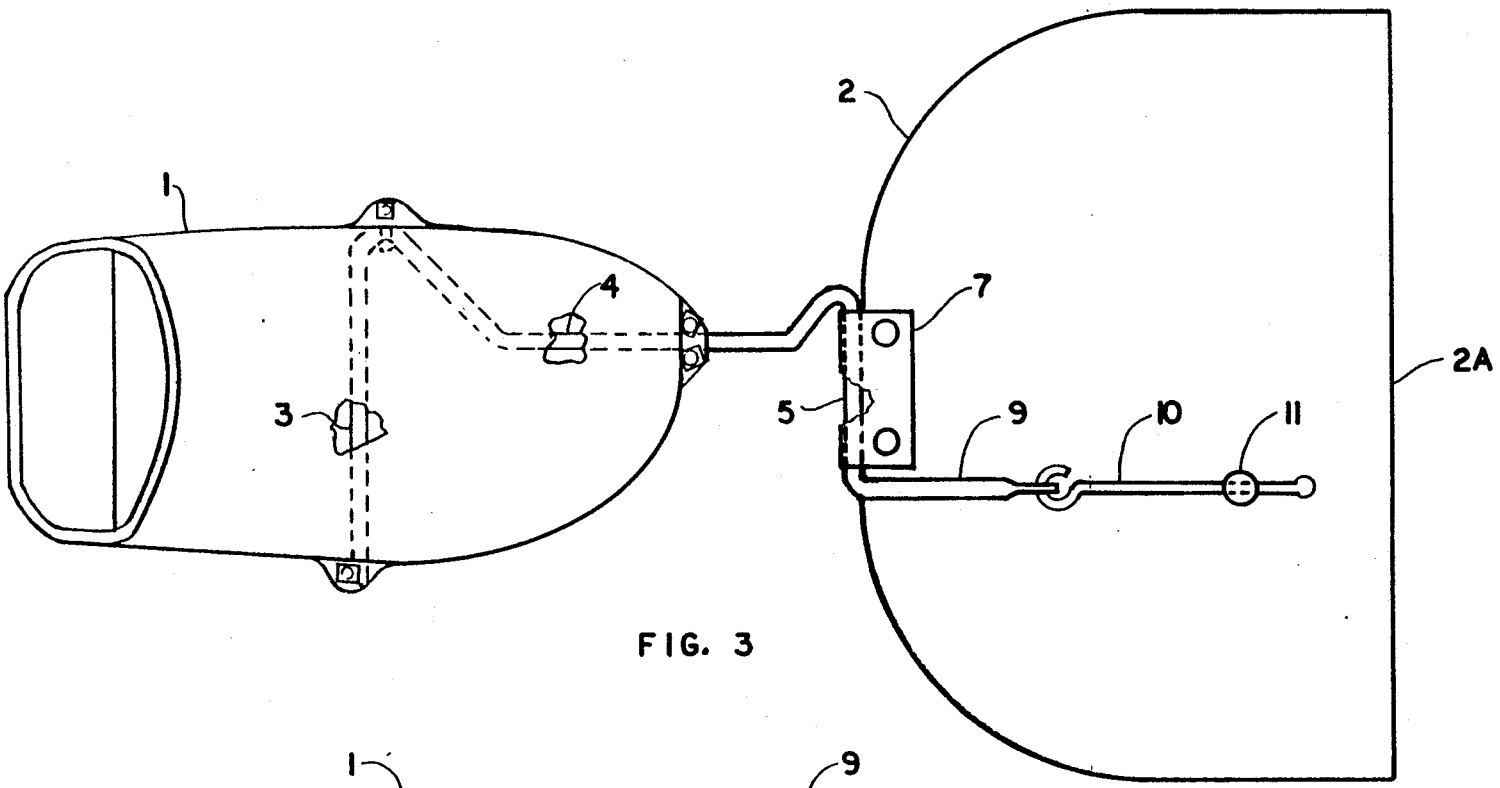
FIGS. 3 and 4 are a top, view, and partial side view, respectively, of the swim fin, illustrating, an optional method of limiting the extent of the angular movement of the rigid blade 2.
Figure 4:
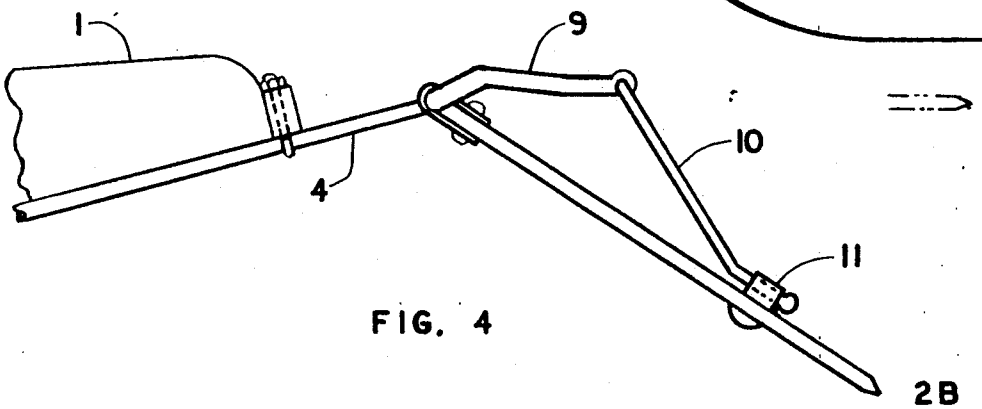

An optional method of limiting the extent of the angular movement of the rigid blade 2 is illustrated in FIGS. 3 and 4.

Referring to FIG. 3, a strut 9, fixidly attached to cross-member 5, projects over the rigid blade 2. In this view the strut 9 contacts the rigid blade 2 thereby stopping farther angular movement of the rigid blade 2.

In the partial side view FIG. 4, the trailing edge of the rigid blade 2 has pivoted to point 2B and farther angular movement has been stopped by the tension member 10 which is operatively connected to the end of the strut 9 and to the eye-screw 11 attached to the rigid blade 2.

The strut 9 may be constructed separately (not shown) and attached to the single beam 4, or constructed as shown in which the rigid member 3, the single cross-member 5 and the strut 9 are constructed as a one piece wire form.

While I have illustrated the preferred embodiment of my invention, it will be understood that this is by way of illustration only and various changes and modifications are contemplated in my invention within the scope of the following claims.

I claim:

1. In a swim fin comprising in combination:

(a) a foot pocket, the foot pocket having a toe portion;

(b) a blade having a leading edge and a trailing edge, the blade being spaced from the toe portion of the foot pocket;

(c) a support beam having a portion attached to the bottom of the foot pocket and the remainder of the support beam projecting to the leading edge of the blade;

(d) a rigid member attached to the portion of the support beam that is under the foot pocket and also to the foot pocket;

(e) a pivotal connection to pivotally attach the support beam to the blade, the pivotal connection being attached to the support beam at a position which is located at the end of the portion of the support beam that projects from the bottom of the foot pocket, and to the blade at a position that is generally located at the center of the leading edge of the blade;

(f) a strut fixedly attached to the blade and projecting to a position near the toe of the foot pocket; and (g) a link connected to the end of the strut and to said support beam.

2. A swim fin comprising, in combination;

(a) a foot pocket which includes a toe portion;

(b) a rigid blade spaced from said foot pocket;

(c) a single beam attached to the bottom of said foot pocket and projecting forwardly to a position that is generally at the center of the leading edge of said rigid blade;

(d) a cross-member attached to said single beam to serve as a hinge pin;

(e) a hinge element fixedly attached to said rigid blade and pivotally connected to said cross-member;

(f) a rigid member attached to the portion of said single beam that is under the foot pocket;

(g) a strut fixedly attached to said rigid blade and projecting to a position near said toe portion of said foot pocket; the strut being positioned on said rigid blade so that said strut projects over part of said single beam that projects from said foot pocket; and (h) a link connected to said strut and said single beam.

3. A swim fin comprising, in combination;

(a) a foot pocket;

(b) a rigid blade spaced from said foot pocket;

(c) a single beam attached to the bottom of said foot pocket and projecting to a position that is generally at the center of the leading edge of said rigid blade;

(d) a cross-member attached to said single beam to serve as a hinge pin;

(e) a hinge element fixedly attached to said rigid blade and pivotally attached to said cross member;

(f) a rigid member fixedly attached to the portion of said single beam that is under said foot pocket;

(g) a strut fixedly attached to said cross member and projecting over said rigid blade to serve as a stop in limiting the angular movement in one direction and (h) non-elastic tension means operatively connected to the end of said strut and to said rigid blade to limit the angular movement of said rigid blade in the other direction.

* * * * *